US009903259B2

(12) United States Patent
Watanabe et al.

(10) Patent No.: US 9,903,259 B2
(45) Date of Patent: Feb. 27, 2018

(54) COOLING APPARATUS FOR INTERNAL COMBUSTION ENGINE

(71) Applicant: TOYOTA JIDOSHA KABUSHIKI KAISHA, Toyota-shi, Aichi-ken (JP)

(72) Inventors: Hiroshi Watanabe, Shizuoka-ken (JP); Ryo Michikawauchi, Numazu (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/164,048

(22) Filed: May 25, 2016

(65) Prior Publication Data

US 2016/0348567 A1 Dec. 1, 2016

(30) Foreign Application Priority Data

Jun. 1, 2015 (JP) ..... 2015-111576

(51) Int. Cl.
*F01P 7/16* (2006.01)
*F01P 7/14* (2006.01)

(52) U.S. Cl.
CPC ..... *F01P 7/167* (2013.01); *F01P 2007/146* (2013.01)

(58) Field of Classification Search
CPC ..... F01P 7/167; F01P 2007/146
See application file for complete search history.

(56) References Cited

U.S. PATENT DOCUMENTS 4,545,333 A 10/1985 Nagumo et al.

FOREIGN PATENT DOCUMENTS

| | | | | |
|---|---|---|---|---|
| EP | 1279800 A2 | * | 1/2003 | ..... F01P 7/167 |
| JP | S59-226225 A | | 12/1984 | |
| JP | 2004-293470 A | * | 10/2004 | |
| JP | 2012-047121 A | | 3/2012 | |

* cited by examiner

*Primary Examiner* — Kevin A Lathers
(74) *Attorney, Agent, or Firm* — Andrews Kurth Kenyon LLP

(57) ABSTRACT

A change in a valve opening degree from an opening degree (a) to an opening degree (d) is caused by a decrease in a radiator outlet water temperature, and at such time a flow rate through a radiator enters a boiling region. Therefore, when such entry is predicted, a target engine outlet water temperature is forcedly changed from 105° C. to 100° C. Thereupon, the valve opening degree is changed from the opening degree (a) to an opening degree (f). The flow rate through the radiator when the valve opening degree is the opening degree (f) is greater than the flow rate through the radiator when the valve opening degree is the opening degree (d), and furthermore, the flow rate through the radiator does not enter the boiling region while the valve opening degree is changing from the opening degree (a) to the opening degree (f).

2 Claims, 4 Drawing Sheets

S10: TEMPERATURE ADJUSTMENT CONTROL IN PROGRESS?
S12: RADIATOR OUTLET WATER TEMPERATURE
< INTERSECTION POINT TEMPERATURE?
S14: CHANGE TARGET ENGINE OUTLET WATER TEMPERATURE

COOLING APPARATUS FOR INTERNAL COMBUSTION ENGINE

CROSS-REFERENCE TO RELATED APPLICATION

The present application claims priority to Japanese Patent Application No. 2015-111576 filed on Jun. 1, 2015, which is incorporated herein by reference in its entirety.

BACKGROUND

Technical Field

Field of the Invention

The present disclosure relates to a cooling apparatus for an internal combustion engine.

Background Art

As disclosed, for example, in JPS59-226225A, a cooling apparatus for an internal combustion engine is known that includes: a cooling water circulation passage that connects a radiator and a water jacket of a main body of the internal combustion engine; a flow rate control valve that is provided in the cooling water circulation passage and is configured so that an opening degree thereof can be changed; and a control unit that is configured to subject the opening degree of the flow rate control valve to feedback control so that a temperature of cooling water flowing through the cooling water circulation passage matches a target temperature. In the above described cooling apparatus, the aforementioned target temperature is switched between two temperatures, namely, a temperature on a high temperature side and a temperature on a low temperature side, based on the load and speed of the internal combustion engine, and in addition the opening degree of the flow rate control valve is subjected to feedback control. Thus, the cooling water temperature can be maintained at an optimal temperature in accordance with the operating state of the internal combustion engine.

LIST OF RELATED ART

Following is a list of patent literatures which the applicant has noticed as related arts of the present disclosure.

[Patent Literature 1]
JPS59-226225A

[Patent Literature 2]
JP2012-047121A

SUMMARY

In this connection, in general, friction between pistons and cylinders in an internal combustion engine can be decreased as the cooling water temperature increases. Therefore, from a viewpoint of reducing friction it is desirable to set a target temperature of cooling water to a temperature in the vicinity of the boiling point thereof. In this regard, according to the above described cooling apparatus, since the amount of cooling water that flows to the cooling water circulation passage can be regulated by the flow rate control valve, the temperature that is on the high temperature side among the aforementioned two target temperatures can also be set to a temperature that is on a low temperature side relative to the boiling point and is also in the vicinity of the boiling point. However, when the temperature is in the vicinity of the boiling point, there is a drawback that if the flow rate of cooling water that is introduced from the radiator to the water jacket is decreased, local boiling of cooling water is liable to occur in narrow flow channels (drill paths) that are formed between the cylinders of the internal combustion engine. Therefore, in the above described cooling apparatus, there is the problem that if the opening degree of the flow rate control valve is simply reduced merely because the temperature of cooling water that flows through the cooling water circulation passage is less than a temperature in the vicinity of the boiling point, the risk of local boiling of cooling water occurring will immediately increase.

The present disclosure aims at solving at least partially the above described problem. That is, an object of the present disclosure is to suppress the occurrence of local boiling of cooling water in a case where, from the viewpoint of reducing friction, a target temperature of cooling water is set to a temperature which is on a low temperature side relative to a boiling point of the cooling water and which is a temperature in the vicinity of the boiling point.

A first aspect of an embodiment of the present disclosure is a cooling apparatus for an internal combustion engine that circulates cooling water between the internal combustion engine and a radiator, comprising a control unit that is configured to control a circulation flow rate that is a flow rate of circulating cooling water that circulates between the internal combustion engine and the radiator so that an engine outlet water temperature that is a temperature of cooling water that flows from an outlet of a cooling water channel of the internal combustion engine is brought close to a target temperature, by using a feedforward model that is constructed so as to reduce the circulation flow rate with increasing the target temperature of the engine outlet water temperature and with decreasing a radiator outlet water temperature that is a temperature of cooling water that flows from an outlet of a cooling water channel of the radiator;

wherein the control unit is further configured to:

set the target temperature to a first temperature that is higher than a temperature at which it is determined that warming up of the internal combustion engine is completed and is a lower temperature than a boiling point of cooling water that is circulated between the internal combustion engine and the radiator;

calculate as a determination temperature the radiator outlet water temperature at the circulating cooling water starts boiling and also in a case where the target temperature is at the first temperature, in accordance with a relationship between the circulation flow rate and the engine outlet water temperature that is established in a case where the circulating cooling water starts boiling; and change the he target temperature from the first temperature to a second temperature that is lower than the first temperature, in a case where the radiator outlet water temperature is less than the determination temperature.

A second aspect of an embodiment of the present disclosure is the cooling apparatus for an internal combustion engine according to the first aspect, wherein the control unit is further configured to:

calculate, in accordance with the relationship, as a second determination temperature the radiator outlet water temperature at the circulating cooling water starts boiling and also in a case where the target temperature is at the second temperature; and continue to change the second temperature to a lower temperature until the radiator outlet water temperature becomes higher than the second determination temperature.

According to the first aspect discussed above, in a case where a radiator outlet water temperature is less than a determination temperature, a target temperature of the engine outlet water temperature can be changed from a first temperature to a second temperature that is lower than the first temperature. A feedforward model that the control unit uses is constructed so as to reduce a circulation flow rate as the target temperature increases, and to reduce the circulation flow rate as the radiator outlet water temperature decreases. Consequently, when a case is assumed in which the target temperature continues to be maintained at the first temperature, if the radiator outlet water temperature falls, the circulation flow rate will be decreased by the feedforward model and therefore local boiling of circulating cooling water will occur. In this respect, by changing the target temperature from the first temperature to the second temperature according to the present disclosure, since the circulation flow rate is increased by the feedforward model, the occurrence of local boiling of circulating cooling water can be suppressed in comparison to a case where the target temperature continues to be maintained at the first temperature.

Even if the target temperature is changed to the second temperature, if the radiator outlet water temperature is lower than a second determination temperature, there remains a possibility that local boiling of the circulating cooling water will occur. In this respect, according to the second aspect discussed above, since the second temperature continues to be changed to a lower temperature until the radiator outlet water temperature becomes higher than the second determination temperature, the possibility of local boiling of the circulating cooling water occurring can be reduced without limit.

DETAILED DESCRIPTION

[Description of Cooling Apparatus Configuration]

Figure 1:
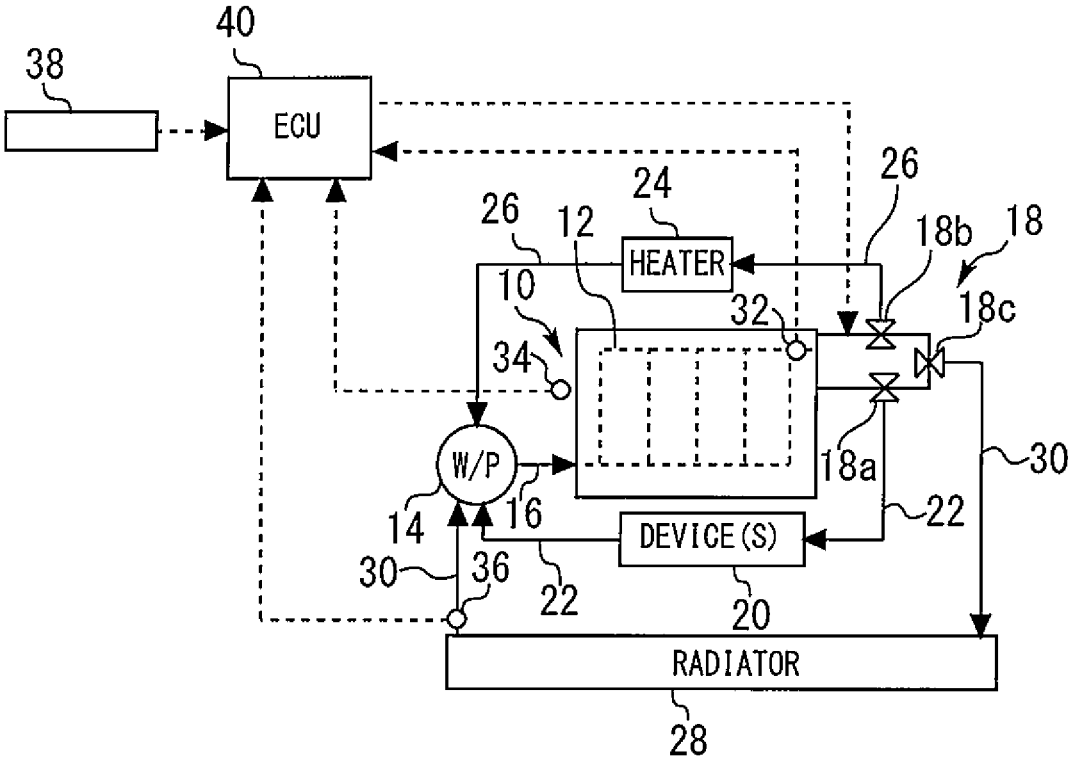
FIG. 1 is a view for describing the configuration of a cooling apparatus of an embodiment of the present disclosure.

FIG. 1 is a view for describing the configuration of a cooling apparatus of an embodiment of the present disclosure. As illustrated in FIG. 1, the cooling apparatus of the present embodiment includes an engine 10 as a multi-cylinder internal combustion engine that is mounted in a vehicle. A water jacket 12 is provided in a main body (cylinder block or cylinder head) of the engine 10. Heat exchange is performed between cooling water that flows through the water jacket 12, and the engine 10.

The cooling water that flows through the water jacket 12 is pressure-fed from a water pump (W/P) 14. The water pump 14 is a belt-type water pump that drives as a result of a driving force of the engine 10 being transmitted thereto through a belt. An inlet portion of the water jacket 12 and a discharge port (not shown) of the water pump 14 are connected by a supply passage 16. An inflow port (not shown) of a control valve 18 is connected to an outlet portion of the water jacket 12.

The control valve 18 is a DC-motor-driven valve with which an inflow destination of cooling water that is discharged from the outlet portion of the water jacket 12 can be switched between a plurality of branch passages. Specifically, a discharge port (not shown) of the control valve 18 is connected to an inflow port of a branch passage 22 along which a device 20 (for example, a transmission warmer, an oil cooler, an EGR cooler or the like) is provided, an inflow port (not shown) of a branch passage 26 along which a heater 24 for vehicle cabin air conditioning is provided, and an inflow port (not shown) of a branch passage 30 along which a radiator 28 is provided. Branch valves 18*a*, 18*b* and 18*c* are provided at connection locations between the discharge port of the control valve 18 and the inflow ports of the respective branch passages.

When the branch valve 18*a* is actuated to cause the control valve 18 and the branch passage 22 to communicate, cooling water flows into the device 20 and heat exchange is performed between the cooling water and a fluid (oil, EGR gas or the like) that flows through the device 20. Further, when the branch valve 18*b* is actuated to cause the control valve 18 and the branch passage 26 to communicate, cooling water flows into the heater 24 and heat exchange is performed between the cooling water and air for heating the vehicle cabin. Furthermore, when the branch valve 18*c* is actuated to cause the control valve 18 and the branch passage 30 to communicate, cooling water flows into the radiator 28 and heat exchange is performed between the cooling water and outside air. A discharge port (not shown) of each branch passage is connected to an intake port (not shown) of the water pump 14. Cooling water that flows into the water pump 14 from the respective branch passages is pressure-fed to the supply passage 16.

The coolant apparatus of the present embodiment also includes an ECU (electronic control unit) 40. The ECU 40 includes at least an input/output interface, a memory and a CPU. The input/output interface is provided in order to take in sensor signals from various sensors, and to also output actuating signals to actuators. The sensors from which the ECU 40 takes in signals include a temperature sensor 32 for detecting the cooling water temperature at an outlet portion of the water jacket 12 (hereunder, also referred to as "engine outlet water temperature"), a crank angle sensor 34 for detecting the speed of the engine 10 (hereunder, also referred to as "engine speed"), a temperature sensor 36 for detecting a cooling water temperature at an outlet portion of the radiator 28 (hereunder, also referred to as "radiator outlet water temperature"), and an accelerator opening degree sensor 38 for detecting a depression amount of an accelerator pedal (not shown) as an accelerator opening degree. The actuators to which the ECU 40 sends an actuating signal include the aforementioned control valve 18. Various kinds of control programs and maps and the like are stored in the memory. The CPU reads out a control program or the like from the memory and executes the control program or the like, and generates actuating signals based on sensor signals that are taken in.

The control performed by the ECU 40 includes startup control. The startup control is control that actuates the branch valves 18*a* to 18*c* so that a state is entered in which communication between the control valve 18 and the branch passages 22, 26 and 30 is cut off to promote warming-up at a time of cold starting of the engine 10. The startup control is performed in a case where the engine outlet water temperature is less than a predetermined temperature. The startup control is ended when the engine outlet water temperature rises and becomes equal to or higher than the predetermined temperature, and the respective branch valves are actuated so that the control valve 18 and the respective branch passages communicate in accordance with various requests (for example, a request to cool the cooling water, a request to warm-up the transmission, or a request for vehicle cabin air conditioning from the driver).

Figure 2:
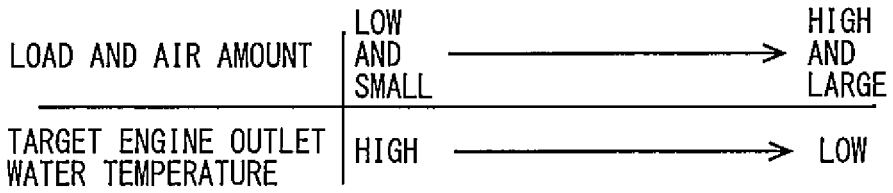
FIG. 2 is a view that illustrates the relationship between the target engine outlet water temperature and the engine load.

The control performed by the ECU 40 also includes temperature adjustment control. The temperature adjustment control is control that, in a case where the engine outlet water temperature is equal to or greater than the predetermined temperature, subjects the flow rate of cooling water that is caused to pass through the radiator 28 (hereunder, also referred to as "flow rate through the radiator") to feedforward control so that the engine outlet water temperature is brought close to a target temperature (hereunder, also referred to as "target engine outlet water temperature"). In the temperature adjustment control, the target engine outlet water temperature is set based on a load and air amount of the engine 10 (hereunder, also referred to as "engine load") that is determined based on the degree of accelerator opening. FIG. 2 is a view that illustrates the relationship between the target engine outlet water temperature and the engine load. As illustrated in FIG. 2, the target engine outlet water temperature is set to a high temperature when the engine load is on a low load and small air amount side, and is set to a low temperature when the engine load is on a high load and large air amount side. The reason is that it is attempted to reduce friction between the pistons and cylinder on the low load and small air amount side, while on the high load and large air amount side it is attempted to avoid the occurrence of knocking. However, the target engine outlet water temperature is set to a higher temperature than the aforementioned predetermined temperature.

Figure 3:
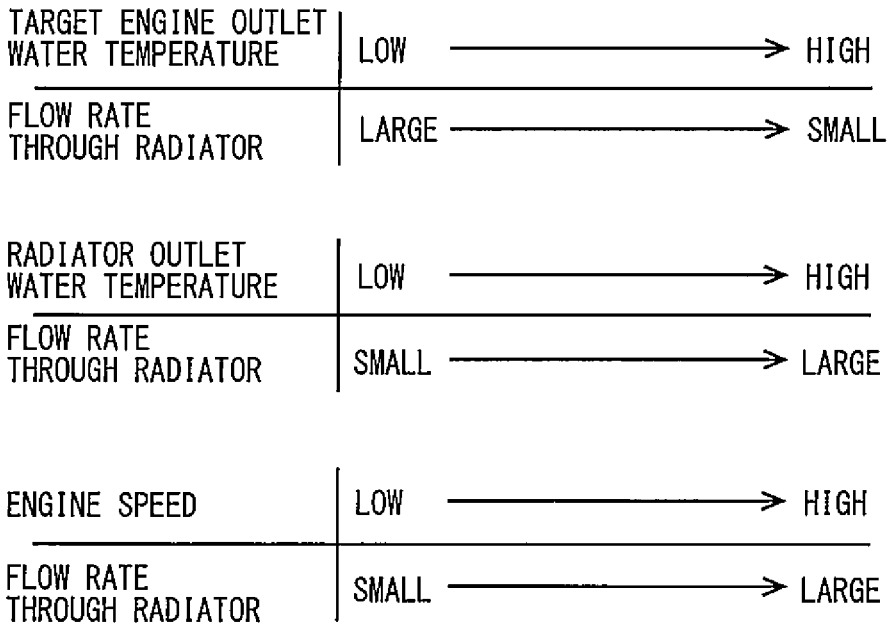
FIG. 3 is a view illustrating a feedforward model that is used in the temperature adjustment control.

Further, according to the temperature adjustment control, a basic opening degree of the branch valve 18*c* is set based on the target engine outlet water temperature. Once the basic opening degree is set, the basic opening degree is corrected depending on the radiator outlet water temperature and the engine speed (cc speed of the water pump 14). By this means, a final target opening degree of the branch valve 18*c* is determined. The branch valve 18*c* is then actuated in accordance with the target opening degree that is determined. FIG. 3 is a view illustrating a feedforward model that is used in the temperature adjustment control, and shows a relationship between the flow rate through the radiator and the target engine outlet water temperature, radiator outlet water temperature, and engine speed. As shown in the upper section of FIG. 3, the flow rate through the radiator is controlled so as to increase when the target engine outlet water temperature is low, and to decrease when the target engine outlet water temperature is high. That is, in accordance with the feedforward model, the aforementioned basic opening degree is set to a large opening degree when the target engine outlet water temperature is low, and the basic opening degree is set to a small opening degree when the target engine outlet water temperature is high.

Further, as shown in the middle section of FIG. 3, the flow rate through the radiator is controlled so as to decrease when the radiator outlet water temperature is low, and to increase when the radiator outlet water temperature is high. That is, in the feedforward model, the aforementioned basic opening degree is corrected so as to decrease the opening degree of the branch valve 18*c* when the radiator outlet water temperature is low, and so as to increase the opening degree of the branch valve 18*c* when the radiator outlet water temperature is high. Furthermore, as shown in the lower section of FIG. 3, the flow rate through the radiator is controlled so as to decrease when the engine speed is low, and to increase when the engine speed is high. That is, in accordance with the feedforward model, the aforementioned basic opening degree is corrected so as to decrease the opening degree of the branch valve 18*c* when the engine speed is low, and so as to increase the opening degree of the branch valve 18*c* when the engine speed is high.

[Feature of the Present Embodiment]

As described above, from the viewpoint of attempting to reduce friction, it is desirable to set the target temperature of cooling water to a temperature that is close to an upper limit of a range in which the cooling water does not boil. The boiling point of cooling water (LLC) that is used in the present embodiment is between 110° C. and 120° C., although the boiling point depends on the pressure within the channel that includes the water jacket 12, the supply passage 16 and the branch passage 30. Therefore, according to the temperature adjustment control of the present embodiment, when the engine load is a low load and a small air amount, the target engine outlet water temperature is set to a temperature in the vicinity of the aforementioned boiling point (specifically, between 80° C. and 110° C.).

Figure 4:
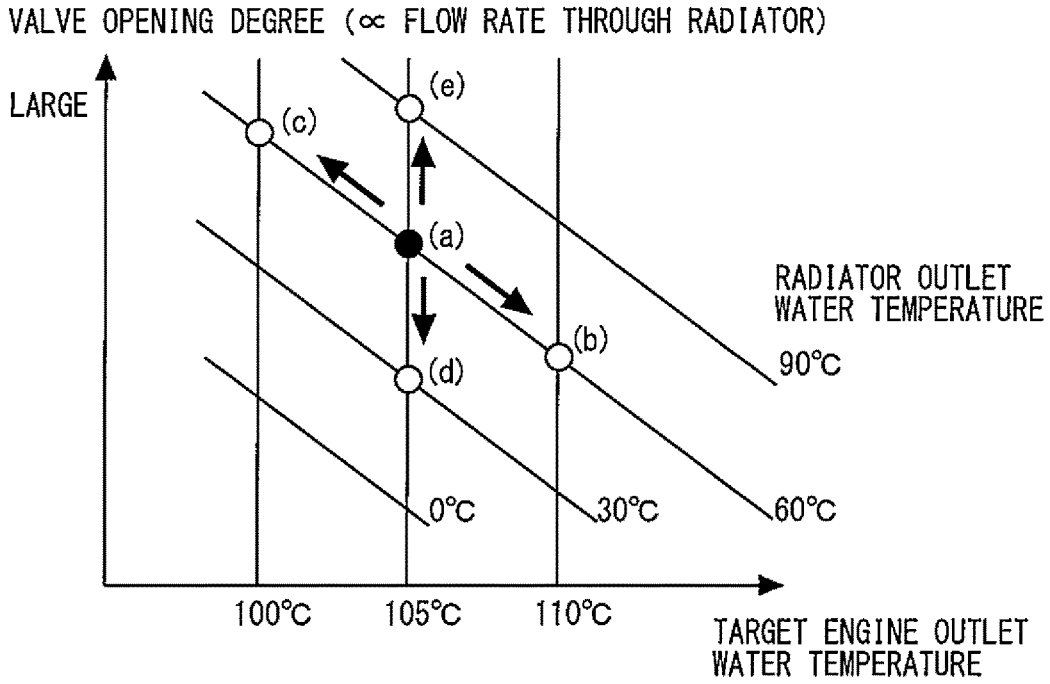
FIG. 4 is a view for describing temperature adjustment control in a case where the target engine outlet water temperature is set to 105° C.

FIG. 4 is a view for describing temperature adjustment control in a case where the target engine outlet water temperature is set to 105° C. Note that, in the description of FIG. 4, it is assumed that the engine speed is constant. In a case where a valve opening degree (refers to the opening degree of the branch valve 18*c*; the same applies hereunder) is an opening degree (a), when the engine load changes to a low load and small air amount side while the radiator outlet water temperature is unchanged at 60° C., the target engine outlet water temperature is changed to 110° C. (refer to the description of FIG. 2). In this case, since the engine speed and the radiator outlet water temperature do not change, in accordance with the above described feedforward model, the basic opening degree that is set based on the target engine outlet water temperature after the change (that is, 110° C.) is adopted as it is as the final target opening degree. Accordingly, the valve opening degree is changed from the opening degree (a) to an opening degree (b). Similarly, in a case where the valve opening degree is the opening degree (a), when the engine load changes to a high load and large air amount side while the radiator outlet water temperature is unchanged at 60° C., the target engine outlet water temperature is changed to 100° C., and the target opening degree is determined based on the target engine outlet water temperature after the change. Accordingly, the valve opening degree is changed from the opening degree (a) to an opening degree (c).

Further, in a case where the valve opening degree is the opening degree (a), when the radiator outlet water temperature decreases from 60° C. to 30° C. while the engine load is unchanged, the valve opening degree is changed from the opening degree (a) to an opening degree (d). Since the target engine outlet water temperature is unchanged at 105° C., the basic opening degree of the branch valve 18*c* does not change. Further, since the engine speed also does not change, in accordance with the above described feedforward model, the basic opening degree is corrected so as to decrease the valve opening degree in accordance with the radiator outlet water temperature after the decrease (that is, 30° C.) (refer to the description of FIG. 3). Hence, the valve opening degree is changed from the opening degree (a) to the opening degree (d). Similarly, in a case where the valve opening degree is the opening degree (a), when the radiator outlet water temperature increases from 60° C. to 90° C. while the engine load is unchanged, the valve opening degree is changed from the opening degree (a) to an opening degree (e).

In this connection, in the description of FIG. 4, changing of the valve opening degree from the opening degree (a) to the opening degree (d) is performed when the outdoor air temperature is low and therefore the radiator outlet water temperature decreases. However, according to the temperature adjustment control of the present embodiment, since the target engine outlet water temperature is set to a temperature in the vicinity of the boiling point of the cooling water, if the flow rate through the radiator is decreased by changing the valve opening degree in this manner, the flow rate of cooling water that undergoes heat exchange when passing through the radiator 28 (that is, cooling water whose temperature is made a low temperature) will also decrease. In such a case, there will also be a decrease in the flow rate of cooling water which flows into the water pump 14 after passing through the radiator 28 and which is subsequently pressure-fed to the water jacket 12 by the water pump 14 (that is, the flow rate of cooling water whose temperature is made a low temperature). Consequently, cooling of the engine 10 will be inadequate, and local boiling of cooling water will occur in drill paths.

Figure 5:
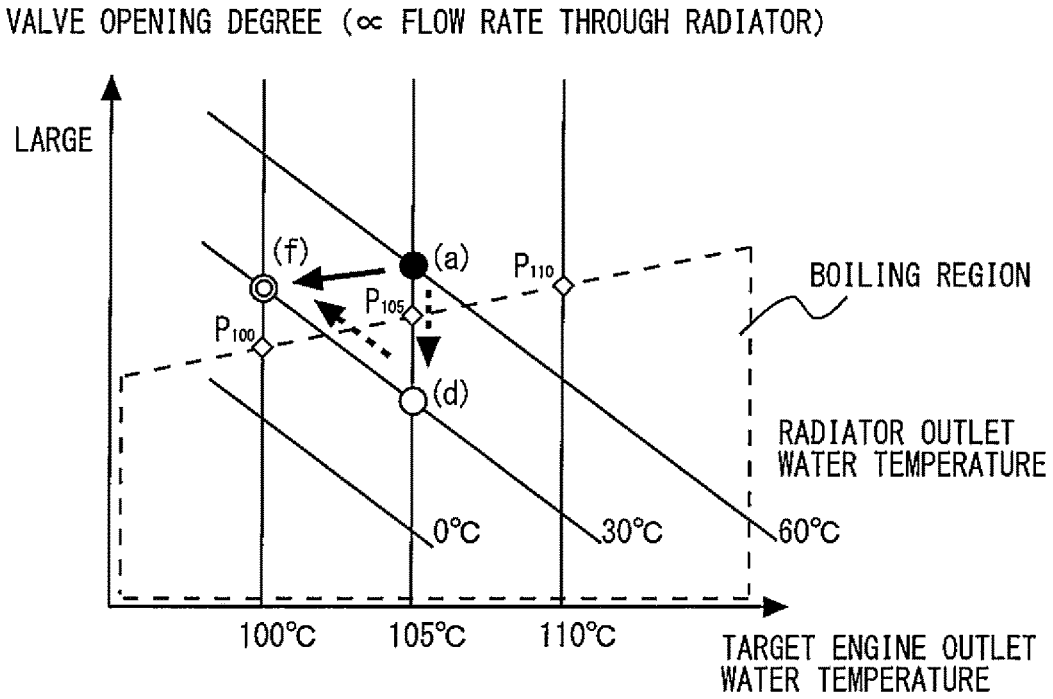
FIG. 5 is a view for describing an outline of a technique for decreasing the target engine outlet water temperature in the present embodiment.

Therefore, in the present embodiment, in a case where the radiator outlet water temperature decreases during temperature adjustment control, it is predicted whether or not local boiling of cooling water will occur accompanying a change in the valve opening degree. Further, a configuration is adopted so that, if the occurrence of boiling is predicted, the target engine outlet water temperature is forcedly decreased irrespective of a change in the engine load. FIG. 5 is a view for describing an outline of a technique for decreasing the target engine outlet water temperature in the present embodiment. Note that, in the description of FIG. 5, similarly to FIG. 4, it is assumed that the engine speed is constant.

A region (boiling region) surrounded by a dashed line in FIG. 5 is a region that corresponds to flow rates through the radiator at which the cooling water boils. A change in the valve opening degree from the opening degree (a) to the opening degree (d) is caused by a decrease in the radiator outlet water temperature that is described in FIG. 4, and at such time the flow rate through the radiator enters the boiling region. Therefore, in the present embodiment, when the aforementioned entry into the boiling region is predicted, the target engine outlet water temperature is forcedly changed from 105° C. to 100° C. Thereupon, the valve opening degree is changed from the opening degree (a) to the opening degree (f). The flow rate through the radiator when the valve opening degree is the opening degree (f) is greater than the flow rate through the radiator when the valve opening degree is the opening degree (d), and furthermore the flow rate through the radiator does not enter the boiling region while the valve opening degree is changing from the opening degree (a) to the opening degree (f). Accordingly, the occurrence of local boiling of cooling water accompanying a change in the valve opening degree can be avoided.

A technique that temporarily increases the flow rate through the radiator to thereby decrease the cooling water temperature itself is also conceivable as a technique for avoiding the occurrence of local boiling of cooling water accompanying a change in the valve opening degree. However, since fuel consumption will deteriorate if the flow rate through the radiator is increased, the aforementioned technique is not necessarily appropriate from the viewpoint of the effect achieved by avoiding boiling relative to the fuel consumption. In this regard, because the technique of the present embodiment decreases the target engine outlet water temperature without changing the framework of the temperature adjustment control that uses a feedforward model, the technique of the present embodiment has the advantage that the occurrence of local boiling of cooling water can be avoided while keeping a deterioration in fuel consumption to the minimum.

Note that, in the present embodiment, a map of radiator outlet water temperatures (hereunder, also referred to as "intersection point temperature map") that pass through intersection points P ($P_{110}$, $P_{105}$, $P_{100}$, . . . ) between the boundary of the boiling region and target engine outlet water temperatures as shown in FIG. 5 is stored in the memory of the ECU 40. For example, the intersection point temperature map is created as follows. First, while keeping the operating conditions (engine load and engine speed) of the engine 10 constant, the opening degree of the branch valve 18*c* is gradually decreased to reduce the flow rate through the radiator. Next, if boiling of cooling water occurs in a drill path during actuation of the branch valve 18*e*, the opening degree of the branch valve 18*c*, the engine outlet water temperature and the radiator outlet water temperature at the time that the boiling occurs are recorded. The intersection point temperature map is created by performing this series of operations while changing the operating conditions of the engine 10.

[Specific Control]

Figure 6:
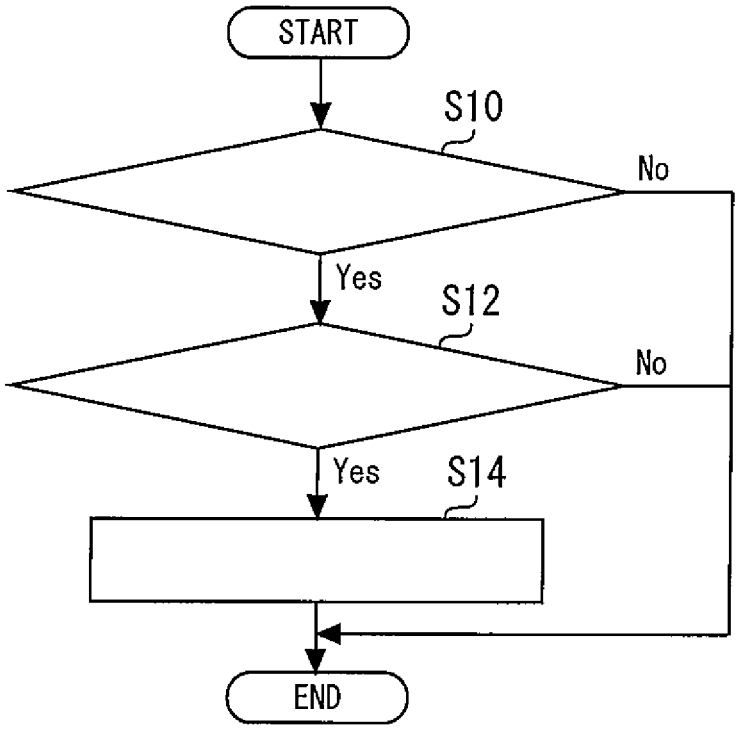
FIG. 6 is a flowchart illustrating a routine for changing the target engine outlet water temperature that is executed by the ECU 40 in the present embodiment.

Next, specific processing for realizing the above described functions will be described while referring to FIG. 6. FIG. 6 is a flowchart illustrating a routine for changing the target engine outlet water temperature that is executed by the ECU 40 in the present embodiment. The routine illustrated in FIG. 6 is repeatedly executed for each predetermined control period immediately after starting the engine 10.

In the routine shown in FIG. 6, first, it is determined whether or not temperature adjustment control is being performed normally (step S10). In the present step, more specifically, it is determined whether or not the engine outlet water temperature is equal to or greater than a predetermined temperature and whether or not the temperature sensors 32 and 36 and the control valve 18 are functioning normally. If it is determined that the engine outlet water temperature is less than the predetermined temperature, or if it is determined that the temperature sensor 32 or 36 or the control valve 18 is abnormal, the ECU 40 exits the present routine. Note that the temperature adjustment control itself is executed in accordance with a different routine from the present routine.

In step S10, if it is determined that the temperature adjustment control is being performed normally, the ECU 40 determines whether or not the radiator outlet water temperature is less than an intersection point temperature (step S12). More specifically, in the present step, using a target opening degree of the branch valve 18*c*, a target engine outlet water temperature, and operating conditions of the engine 10 as search keys, the ECU 40 searches for a radiator outlet water temperature (that is, an intersection point temperature) at a time that local boiling of cooling water occurs based on the intersection point temperature map that is read from the memory. The intersection point temperature is then compared with the actual radiator outlet water temperature that is detected by the temperature sensor 36. If it is determined as the result of the comparison that the actual radiator outlet water temperature is greater than or equal to the intersection point temperature, since it can be predicted that the cooling water will not boil, the ECU 40 exits the present routine.

On the other hand, if it is determined as the result of the comparison in step S12 that the actual radiator outlet water temperature is less than the intersection point temperature, since it can be predicted that the cooling water will boil, the ECU 40 changes the target engine outlet water temperature (step S14). In the present step, more specifically, a temperature (setting value) that is lower than the current target engine outlet water temperature is adopted as a candidate for a target engine outlet water temperature (hereunder, also referred to as "target temperature candidate"). Next, a target opening degree of the branch valve 18*c* is determined based on the target temperature candidate. Note that the technique for determining the target opening degree of the branch valve 18*c* is as described above. Next, using the thus-determined target opening degree of the branch valve 18*c*, the target temperature candidate, and the operating conditions of the engine 10 as search keys, the ECU 40 searches for a radiator outlet water temperature at a time that local boiling of the cooling water occurs based on the intersection point temperature map. Next, similarly to step S12, the ECU 40 compares the radiator outlet water temperature that is retrieved as a result of the search with the actual radiator outlet water temperature. If it is determined as the result of the comparison that the actual radiator outlet water temperature is greater than or equal to the intersection point temperature, since it can be predicted that the cooling water will not boil, the target temperature candidate is adopted as the formal target engine outlet water temperature. In contrast, if the aforementioned comparison result is not that the actual radiator outlet water temperature is greater than or equal to the intersection point temperature, a temperature (setting value) that is lower still than the target temperature candidate is adopted as a new candidate for the target engine outlet water temperature, and the above described determination is performed. That is, the processing of the present step is repeatedly performed until it is determined that the actual radiator outlet water temperature is equal to or greater than the intersection point temperature.

Thus, according to the routine illustrated in FIG. 6, in a case where the radiator outlet water temperature decreases during temperature adjustment control, even at a time at which the opening degree of the branch valve 18*c* is changed in accordance therewith, the occurrence of local boiling of cooling water can be avoided.

In this connection, although the aforementioned embodiment is described on the premise that the cooling apparatus includes the control valve 18 and the branch passages 22, 26 and 30, the branch passages 22 and 26 and the branch valves 18*a* and 18*b* are not essential to the configuration of the present disclosure. That is, as long as the cooling apparatus is a cooling apparatus that controls a flow rate of cooling water that is circulated between the engine 10 and the radiator 28, the present disclosure can be applied thereto.

Further, in the aforementioned embodiment, although the radiator outlet water temperature is detected with the temperature sensor 36, the radiator outlet water temperature may be estimated based on the outdoor air temperature or the vehicle speed.

Further, in the aforementioned embodiment, although the water pump 14 is constituted by a belt-type water pump, the water pump 14 may be constituted by an electric-motor-driven water pump. If an electric-motor-driven water pump is adopted, there is the advantage that the degree of control freedom with respect to the cooling water temperature and the flow rate through the radiator can be increased by combining the electric-motor-driven water pump with the control valve 18. However, in a case where the water pump 14 is constituted by an electric-motor-driven water pump, since the speed thereof will no longer be dependent on the engine speed, the phrase "water pump speed" should be used instead of the phrase "engine speed" at the appropriate places in the description of the aforementioned embodiment. Specifically, in such case, the basic opening degree of the branch valve 18*c* during temperature adjustment control is corrected based on the water pump speed and not the engine speed. Further, the intersection point temperature map is created while keeping the water pump speed, and not the engine speed, constant. Furthermore, when searching in the intersection point temperature map, the engine load and the water pump speed, and not the operating conditions of the engine 10, are adopted as search keys.

Note that, in the above described embodiment, the target engine outlet water temperature corresponds to "first temperature" of the first aspect discussed above, the target temperature candidate in step S14 in FIG. 6 corresponds to "second temperature" of the first aspect discussed above, and the flow rate through the radiator corresponds to "circulation flow rate" of the first aspect discussed above.

The invention claimed is:

1. A cooling apparatus for an internal combustion engine comprising:

a cooling water channel through which cooling water circulating between the internal combustion engine and an radiator flows;

a control valve which is provided in the cooling water channel and is configured to control flow rate of cooling water passing through the radiator;

a temperature sensor which is provided in the cooling water channel and is configured to detect temperature of cooling water at an outlet portion of the radiator; and a control unit which is configured to control the control valve by using a feedforward model, the feedforward model is constructed so as to reduce the flow rate of cooling water passing through the radiator as a target temperature of cooling water at an outlet portion of the internal combustion engine increases;

wherein the control unit is further configured to:

set the target temperature which is input into the feedforward model to a first temperature that is higher than a predetermined temperature at which it is determined that warming up of the internal combustion engine is completed and is lower than a boiling point of cooling water flowing through the cooling water channel;

calculate, as a determination temperature, temperature of cooling water at the outlet portion of the radiator when cooling water flowing through the cooling water channel starts boiling under a condition where the target temperature being input into the feedforward model is set at the first temperature, in accordance with a relationship among flow rate of cooling water passing through the radiator, temperature of cooling water at the outlet portion of the internal combustion engine and temperature of cooling water at the outlet portion of the radiator that is established when water flowing through the cooling water channel starts boiling; and change the target temperature which is input into the feedforward model from the first temperature to a second temperature that is lower than the first temperature when the detected temperature of cooling water at the outlet portion of the radiator is less than the determination temperature.

2. The cooling apparatus for an internal combustion engine according to claim 1, wherein the control unit is further configured to:

calculate, in accordance with the relationship, as a second determination temperature, temperature of cooling water at the outlet portion of the radiator when cooling water flowing through the cooling water channel starts boiling under a condition where the target temperature being input into the feedforward model is set at the second temperature; and continue to change the target temperature being input into the feedforward model to a lower temperature than the second temperature until the detected temperature of cooling water at the outlet portion of the radiator becomes higher than the second determination temperature.

* * * * *